US012613077B2

(12) United States Patent
Porat

(10) Patent No.: US 12,613,077 B2
(45) Date of Patent: Apr. 28, 2026

(54) BARREL SHROUD FOR TILTING BARREL

(71) Applicant: RT Recover Innovations Ltd., Tel Aviv (IL)

(72) Inventor: Tamir Porat, Tel Aviv (IL)

(73) Assignee: RT Recover Innovations Ltd, Tel Aviv (IL)

( * ) Notice: Subject to any disclaimer, the term of this patent is extended or adjusted under 35 U.S.C. 154(b) by 0 days.

(21) Appl. No.: 19/023,428

(22) Filed: Jan. 16, 2025

(65) Prior Publication Data

US 2025/0155220 A1 May 15, 2025

Related U.S. Application Data

(63) Continuation of application No. 18/351,592, filed on Jul. 13, 2023, now abandoned.

(51) Int. Cl.
*F41C 23/16* (2006.01)
*F41C 23/12* (2006.01)

(52) U.S. Cl.
CPC ..... *F41C 23/16* (2013.01); *F41C 23/12* (2013.01)

(58) Field of Classification Search
CPC ..... F41C 21/10; F41C 21/12; F41C 21/16; F41A 11/02
See application file for complete search history.

(56) References Cited

U.S. PATENT DOCUMENTS

| | | | | | |
|---|---|---|---|---|---|
| 2,056,975 | A * | 10/1936 | Michal, Jr. | F41C 23/12 | 42/106 |
| 2,139,691 | A * | 12/1938 | Michal, Jr. | F41C 23/10 | 89/33.02 |
| 3,685,194 | A * | 8/1972 | Coon | F41C 23/10 | 42/72 |
| 5,479,736 | A * | 1/1996 | Forrester | F41A 11/02 | 89/14.05 |
| 5,581,046 | A * | 12/1996 | Weldle | F41A 5/04 | 89/196 |
| 6,318,014 | B1 * | 11/2001 | Porter | F41C 23/12 | 42/71.01 |
| 8,782,942 | B1 * | 7/2014 | Bentley | F41G 1/12 | 42/71.01 |
| 9,709,357 | B1 * | 7/2017 | O'Malley | F41C 23/16 | |
| 10,161,709 | B1 * | 12/2018 | Wright | F41C 7/00 | |
| 11,573,064 | B1 * | 2/2023 | Siepman | F41C 3/00 | |
| 11,692,790 | B2 * | 7/2023 | Porat | F41C 23/12 | 42/69.02 |

(Continued)

FOREIGN PATENT DOCUMENTS

| | | | | |
|---|---|---|---|---|
| DE | 388457 C | * | 1/1921 | |
| EP | 3825644 A1 | * | 5/2021 | F41C 23/12 |

(Continued)

*Primary Examiner* — Gabriel J. Klein
(74) *Attorney, Agent, or Firm* — Heidi Brun Associates Ltd.; Heidi M. Brun

(57) ABSTRACT

A weapon accessory includes a barrel shroud that has left and right side walls from which rearwardly extends an attachment member. An upper member extends between upper portions of the left and right side walls. The upper member does not extend to a distal end of the barrel shroud, and instead a distal opening is left between the upper portions of the left and right side walls. This distal opening accommodates barrel tilt of a barrel extension.

5 Claims, 2 Drawing Sheets

(56) References Cited

U.S. PATENT DOCUMENTS

| | | | | |
|---|---|---|---|---|
| 11,719,501 | B2 * | 8/2023 | Ames | F41A 21/36 42/75.01 |
| 2008/0216377 | A1 * | 9/2008 | Rohrauer | F41C 23/16 42/75.01 |
| 2009/0282718 | A1 * | 11/2009 | Bartley | F41C 23/12 42/75.03 |
| 2010/0186278 | A1 * | 7/2010 | Daniel | F41C 23/16 42/71.01 |
| 2011/0030258 | A1 * | 2/2011 | Fistikchi | F41C 23/22 42/1.06 |
| 2011/0088305 | A1 * | 4/2011 | Oz | F41C 23/12 42/69.01 |
| 2011/0107644 | A1 * | 5/2011 | Faifer | F41C 23/12 42/75.02 |
| 2012/0131829 | A1 * | 5/2012 | Fistikchi | F41C 23/22 42/1.06 |
| 2015/0241154 | A1 * | 8/2015 | Istvanovics | F41A 19/09 89/140 |
| 2015/0316346 | A1 * | 11/2015 | Brandt | F41C 23/12 42/71.02 |
| 2016/0146558 | A1 * | 5/2016 | Kada | F41A 3/56 42/16 |
| 2018/0224234 | A1 * | 8/2018 | Macy | F41A 3/66 |
| 2019/0249969 | A1 * | 8/2019 | Griffith | F41A 17/38 |
| 2021/0131764 | A1 * | 5/2021 | Padovan | F41C 3/00 |
| 2021/0325141 | A1 * | 10/2021 | Mumford | F41A 3/66 |
| 2022/0082344 | A1 * | 3/2022 | Ames | F41A 21/325 |
| 2022/0364822 | A1 * | 11/2022 | Weinberger | F41C 27/00 |
| 2022/0381534 | A1 * | 12/2022 | Vold | F41C 23/06 |
| 2023/0132043 | A1 * | 4/2023 | Porat | F41C 23/12 42/69.02 |
| 2025/0020433 | A1 * | 1/2025 | Porat | F41C 23/16 |

FOREIGN PATENT DOCUMENTS

| | | | | |
|---|---|---|---|---|
| EP | 4170275 | A1 * | 4/2023 | F41C 23/12 |
| WO | WO-2013132291 | A1 * | 9/2013 | F41G 11/004 |
| WO | WO-2025037283 | A1 * | 2/2025 | F41C 23/14 |

* cited by examiner

BARREL SHROUD FOR TILTING BARREL

FIELD OF THE INVENTION

The present invention generally relates to firearms accessories, and particularly to a barrel shroud that accommodates a tilting barrel.

BACKGROUND OF THE INVENTION

Blowback firearms have a fixed barrel. However, for high-pressure rounds, e.g., 9 mm, .40, .45, and others, the momentum of the slide sliding backwards is large, which means the slide mechanism has to be much more massive. This is not desirable because it adds too much weight to the gun. Therefore, most modern auto-loading handguns use a locked-breech design.

In the locked-breech design, the slide and the breech remain locked together as the pressure builds in the chamber and the bullet has exited the barrel. When the slide and barrel move rearwards due to the recoil, the barrel disengages from the slide on the breech end. This unlocking of the breech permits the slide to continue on its rearward movement while ejecting the spent cartridge. The rear part of the barrel then drops down to align with the feeding ramp (which means the forward part of the barrel tilts upward), so that the next cartridge can be stripped from the magazine and enter the chamber. Forward movement of the slide pushes the barrel forward and up into its firing position where the barrel and slide are once again locked and ready for the next shot.

The upward tilt of the barrel and its return to horizontal happen so quickly that many shooters do not notice it. This tilt is normally of no significance to the shooter.

Longer barrel extensions are available for many handguns, such as 16-inch barrel extensions. The longer barrel is rifled and has the benefit of increasing accuracy. In the United States, firearms with barrels over 16 inches are not considered short barreled rifles; therefore, such firearms comply with regulations and avoid extra fees for owning the weapon. The longer the barrel extension, the more noticeable is the upward barrel tilt.

SUMMARY

The present invention seeks to provide a barrel shroud that accommodates a tilting barrel, particularly a barrel extension that tilts during firing of the weapon, as is described hereinbelow in detail. The barrel shroud is particularly useful with pistol stabilizer assemblies (such as, but not limited to, the 20/20 stabilizer made by RECOVER) or a pistol-to-rifle conversion kit (such as, but not limited to, the P-IX made by RECOVER).

There is thus provided in accordance with a non-limiting embodiment of the invention a weapon accessory including a barrel shroud that includes left and right side walls from which rearwardly extends an attachment member, and an upper member that extends between upper portions of the left and right side walls, wherein the upper member does not extend to a distal end of the barrel shroud, and instead a distal opening is left between the upper portions of the left and right side walls.

In accordance with a non-limiting embodiment of the invention, the barrel shroud is coupled to a weapon assembly that includes a weapon with a barrel extension, and the barrel extension is arranged to tilt through the distal opening.

BRIEF DESCRIPTION OF DRAWINGS

The present invention will be understood and appreciated more fully from the following detailed description, taken in conjunction with the drawings in which.

DETAILED DESCRIPTION

Reference is now made to FIGS. 2A-2D, which illustrate a barrel shroud 10, in accordance with a non-limiting embodiment of the present invention. The barrel shroud 10 may be made of a polymer, metal or other suitable material.

Barrel shroud 10 may include left and right side walls 12 and 14 from which rearwardly extends an attachment member 16. Throughout the specification and claims, the terms "rearward" and "forward" are defined with respect to the shooting direction; forward refers to the direction that the cartridge exits the barrel and is propelled toward a target, and rearward is the direction opposite to forward.

Figure 1A:
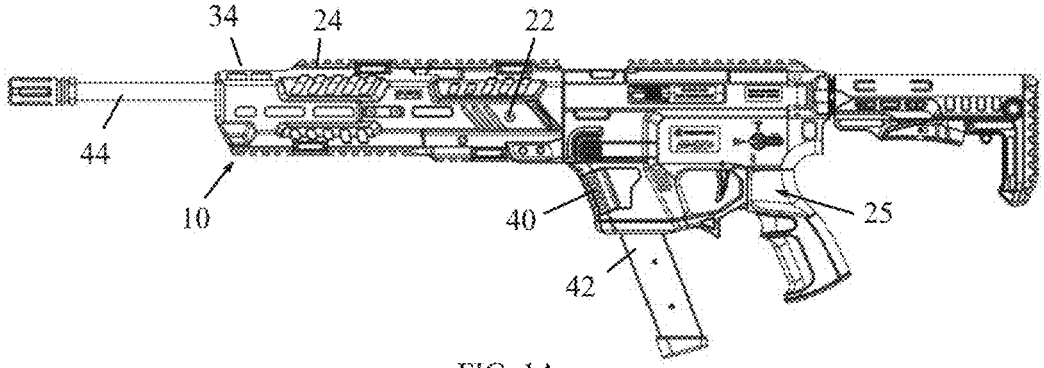
FIGS. 1A and 1B are simplified side-view illustrations of a barrel shroud mounted on a pistol-to-rifle conversion kit, in accordance with a non-limiting embodiment of the present invention, respectively before and after tilting of a barrel extension of a handgun mounted in the pistol-to-rifle conversion kit.
Figure 1B:
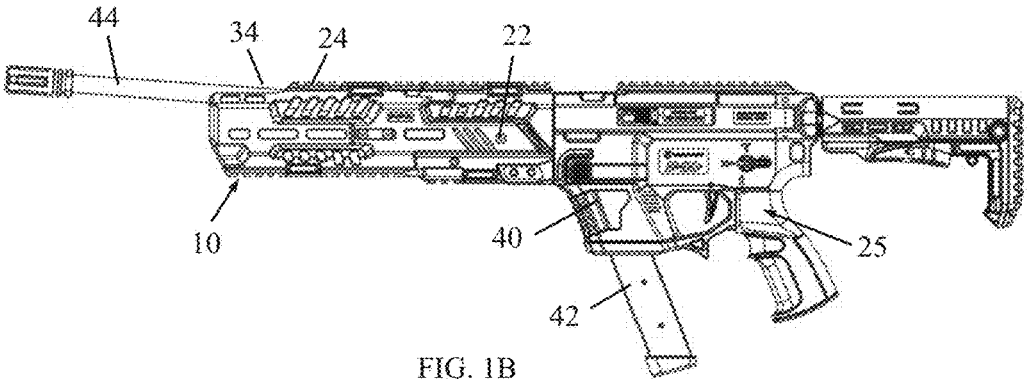
Figure 2A:
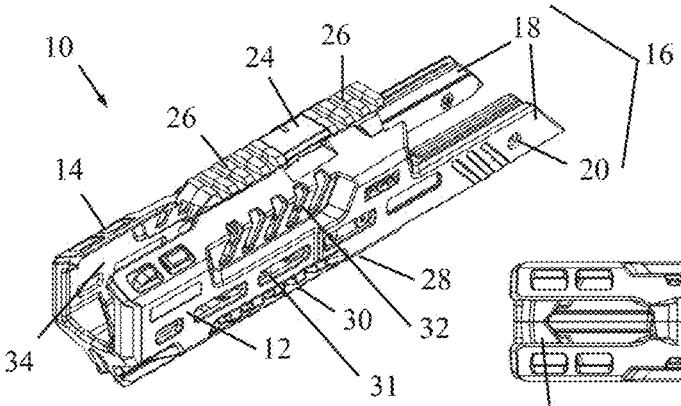
FIGS. 2A, 2B, 2C, and 2D are simplified perspective, top-view, end-view and side-view illustrations of the barrel shroud of FIGS. 1A-1B.
Figure 2B:
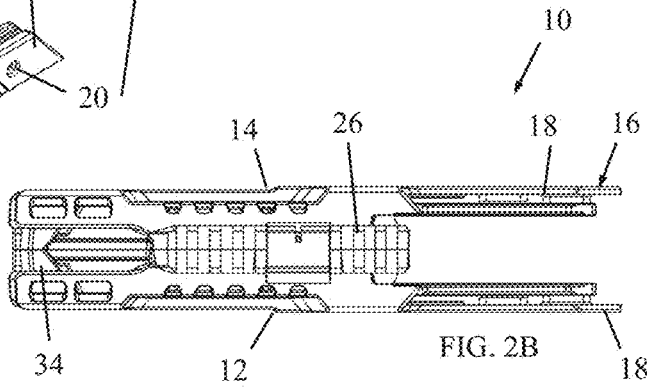
Figure 2C:
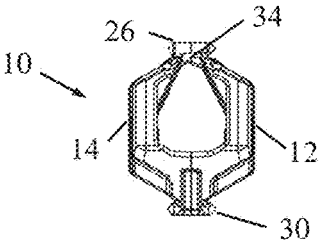
Figure 2D:
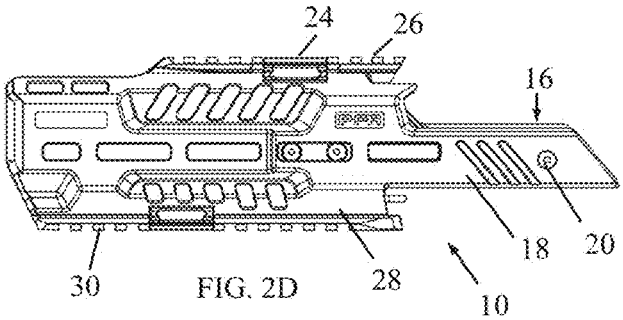

In the illustrated embodiment, the attachment member 16 includes two tongues 18 each formed with a mounting hole 20 (FIGS. 2A and 2D) through which fasteners 22 (FIGS. 1A and 1B), such as screws, can be used to fasten barrel shroud 10 to a pistol-to-rifle conversion kit 25 (FIGS. 1A and 1B). Tongues 18 may extend from a bottom portion of shroud 10 as shown, but alternatively may extend from other portions of shroud 10.

An upper member 24 may extend between upper portions of left and right side walls 12 and 14. The upper member 24 may be provided with a weapon accessory mounting rail 26, such as but not limited to, a Picatinny rail.

Likewise, a lower member 28 may extend between lower portions of left and right side walls 12 and 14. The lower member 28 may be provided with a weapon accessory mounting rail 30, such as but not limited to, a Picatinny rail.

The barrel shroud 10 may be formed with various apertures along its length, such as but not limited to, horizontal elongate apertures 31 and/or tilted elongate apertures 32. The apertures may help reduce weight of the barrel shroud 10 and provide ports for transferring heat from the barrel of the weapon to the ambient atmosphere.

In accordance with a non-limiting embodiment of the present invention, upper member 24 does not extend to a distal (forward) end of barrel shroud 10. Instead, there is an opening 34 (also called distal opening 34) left between the upper portions of left and right side walls 12 and 14.

The purpose of opening 34 is best understood from FIGS. 1A and 1B. The barrel shroud 10 is mounted on pistol-to-rifle conversion kit 25. A handgun 40 is mounted in kit 25 and is provided with a magazine 42 and a barrel extension 44. FIGS. 1A and 1B show the assembly respectively before and after tilting of barrel extension 44. The barrel extension 44 tilts through opening 34. If there were no opening 34, the barrel extension would hit the upper member 24 of the barrel shroud 10.

Figure 3A:
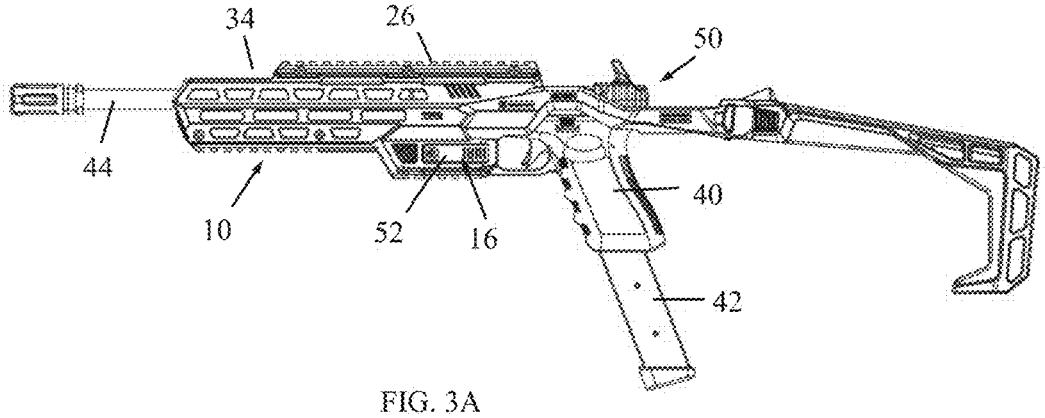
FIGS. 3A and 3B are simplified side-view illustrations of a barrel shroud mounted on a pistol stabilizer assembly, in accordance with a non-limiting embodiment of the present invention, respectively before and after tilting of a barrel extension of a handgun mounted in the pistol stabilizer assembly.
Figure 3B:
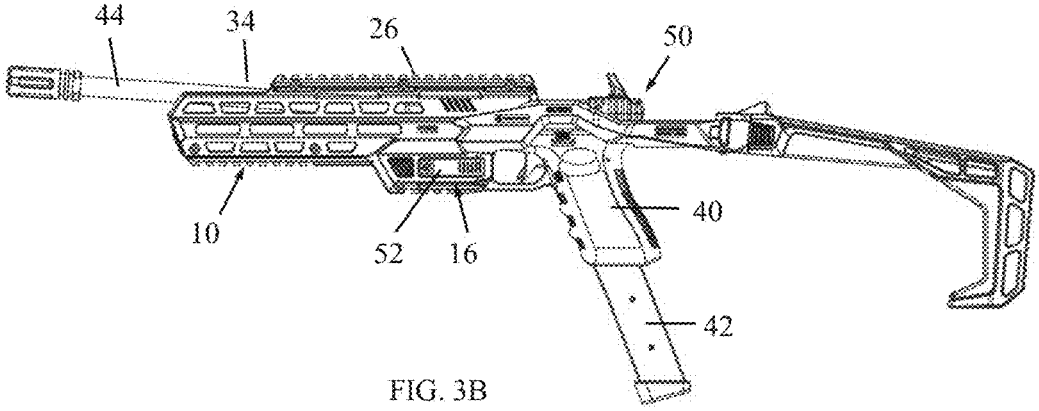
Figure 4A:
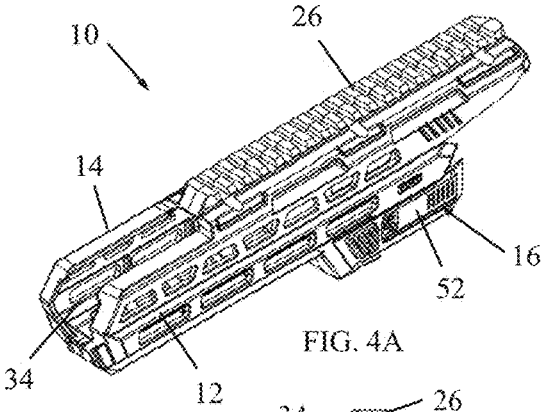
FIGS. 4A, 4B, 4C, and 4D are simplified perspective, top-view, end-view and side-view illustrations of the barrel shroud of FIGS. 3A-3B.
Figure 4B:
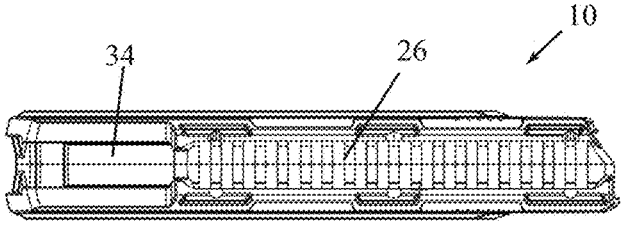
Figure 4C:
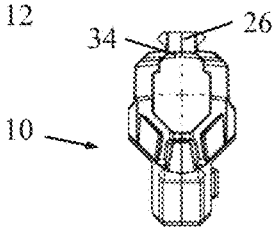
Figure 4D:
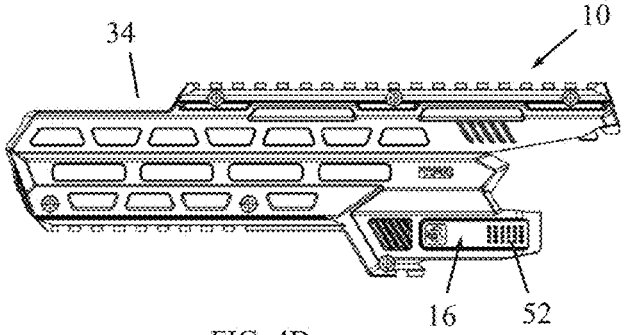

Reference is now made to FIGS. 3A and 3B, and FIGS. 4A-4D, which illustrate another version of barrel shroud 10, with like elements being designated by like numerals. FIGS. 3A and 3B show shroud 10 mounted on a pistol stabilizer assembly 50.

In this version of barrel shroud 10, the attachment member 16 includes resilient flanges 52 that extend rearwardly, which may be positioned on a lower rear portion of shroud 10. The flanges 52 are open facing rearward. In this manner, the shroud 10 is simply slipped over the forward portion of the pistol stabilizer assembly 50, and the flanges 52 resiliently engage (e.g., click or snap on) a portion of the pistol stabilizer assembly 50, such as in front of and near the trigger guard of the assembly. No fasteners are needed.

The barrel shroud of the invention gives an aesthetically pleasant look to the pistol-to-rifle conversion kit or pistol stabilizer assembly, and serves as a handguard as well as allowing for multiple attachment points for accessories such as lights, lasers and optics.

The invention claimed is:

1. A method for allowing a barrel extension to be used with a pistol mounted in a pistol stabilizer assembly or pistol-to-rifle conversion kit, comprising:

providing a barrel shroud that comprises left and right side walls from which rearwardly extends an attachment member, and an upper member that extends between upper portions of said left and right side walls, wherein said upper member does not extend to a distal end of said barrel shroud, and instead a distal opening is left between said upper portions of said left and right side walls; and causing said barrel shroud to be coupled to an existing pistol-to-rifle conversion kit or to an existing pistol stabilizer assembly, so that when a pistol is mounted in said existing pistol-to-rifle conversion kit or in said existing pistol stabilizer assembly and a barrel extension is attached to said pistol, said barrel shroud allows said barrel extension to tilt into said distal opening of said barrel shroud and said barrel extension does not hit said barrel shroud.

2. The method according to claim 1, wherein said barrel shroud is coupled to said existing pistol-to-rifle conversion kit or to said existing pistol stabilizer assembly with one or more fasteners.

3. The method according to claim 1, wherein said barrel shroud is coupled to said existing pistol-to-rifle conversion kit or to said existing pistol stabilizer assembly by resiliently engaging thereto without fasteners.

4. The method according to claim 1, wherein said barrel shroud serves as a handguard.

5. The method according to claim 1, wherein said barrel shroud provides multiple attachment points for weapon accessories.

* * * * *